US006217344B1

(12) United States Patent
Saito et al.

(10) Patent No.: US 6,217,344 B1
(45) Date of Patent: Apr. 17, 2001

(54) CABLE CONNECTOR IN WHICH TWO CONTACTS CLAMP A WIRE CORE OF A CABLE THEREBETWEEN

(75) Inventors: Kazuki Saito; Osamu Hashiguchi, both of Akishima; Hisashi Ishida; Shin Kamiyamane, both of Tokyo, all of (JP)

(73) Assignees: Japan Aviation Electronics Industry, Limited; NEC Corporation, both of Tokyo (JP)

( * ) Notice: Subject to any disclaimer, the term of this patent is extended or adjusted under 35 U.S.C. 154(b) by 0 days.

(21) Appl. No.: 09/536,209

(22) Filed: Mar. 27, 2000

(30) Foreign Application Priority Data

Mar. 29, 1999 (JP) ..... 11-085752

(51) Int. Cl.[7] ..... H01R 9/09
(52) U.S. Cl. ..... 439/67; 439/499
(58) Field of Search ..... 439/67, 495, 498, 439/499, 492, 496, 656

(56) References Cited

U.S. PATENT DOCUMENTS

| | | | | |
|---|---|---|---|---|
| 3,696,319 | * | 10/1972 | Olsson | 339/17 F |
| 4,181,384 | * | 1/1980 | Dola et al. | 339/14 R |
| 4,260,209 | * | 4/1981 | Zell et al. | 339/14 R |
| 4,408,823 | * | 10/1983 | Huber | 339/208 |
| 4,693,539 | * | 9/1987 | Tighe, Jr. | 439/465 |
| 4,749,371 | * | 6/1988 | Hirai et al. | 439/497 |
| 5,231,759 | * | 8/1993 | Olsson | 29/867 |
| 5,601,447 | * | 2/1997 | Reed et al. | 339/208 |

FOREIGN PATENT DOCUMENTS

| | | | |
|---|---|---|---|
| 0018160 | 9/1980 | (EP) . | |
| 80301128 | 9/1980 | (EP) . | |
| 0147080 | 11/1984 | (EP) . | |
| 84308287 | 11/1984 | (EP) . | |
| 5-101853 | 4/1993 | (JP) | H01R/4/48 |
| 10-255921 | 9/1998 | (JP) | H01R/23/02 |

OTHER PUBLICATIONS

Patent Abstracts of Japan; Publication No. 102–44921; publication date Sep. 25, 1998, Appln. No. 09051682 dated Jun. 3, 1997; Inventor Kawabe Eiji; Title: Connector.
EPO Communication Reference No. AG 438–14285.8 dated May 6, 2000 re appln. No. 001067808.1–12131–; Applicant: Japan Aviation Electronics Industry, Limited, et al.

* cited by examiner

*Primary Examiner*—Gary F. Paumen
*Assistant Examiner*—Phuongchi Nguyen
(74) *Attorney, Agent, or Firm*—Laff, Whitesel & Saret, Ltd.; J. Warren Whitesel

(57) ABSTRACT

In a cable connector (1) in which a core wire **(81*a*,81*c*) of a cable (81) is pressed against a base contact (3) in a predetermined direction (a) intersecting the core wire, a support contact (5) is cooperated with the base contact to clamp the core wire therebetween in the predetermined direction. The base contact is coupled to a base insulator (2). The support contact is coupled to a cover insulator (4) movable against the base insulator in the predetermined direction. A partition wall (42)** is formed integral with the cover insulator and positions the core wire to make the core wire face the base contact. When the cover insulator is moved towards the base insulator, the core wire becomes in press contact with the base contact.

6 Claims, 14 Drawing Sheets

CABLE CONNECTOR IN WHICH TWO CONTACTS CLAMP A WIRE CORE OF A CABLE THEREBETWEEN

BACKGROUND OF THE INVENTION

The present invention relates to a connector for a cable and, in particular, to a cable connector suitable for a ribbon-shaped flat cable with core wires arranged at a narrow pitch.

In a typical existing cable connector, wire connection is carried out by using a method in which a core wire of a cable is press-fitted into a slit formed on a press-contact portion of a contact to bring the core wire into press-contact with the contact, or another method in which a core wire of a cable is wrapped or enveloped by a crimping portion of a contact to crimp the core wire to the contact.

In the above-described wire connection methods, however, the press-contact piece or the crimping piece of the contact is no longer adaptable to a present-day multi-wire cable in which core wires are arranged at a narrower pitch.

In order to solve the above-mentioned problem, an invention has been made of a connector in which a core wire of a cable is brought into direct contact with a side surface of a contact without providing the contact with a press-contact piece or a crimping piece, as disclosed in Japanese Unexamined Patent Publications (JP-A) Nos. H05-101853 and H10-255921.

In the electrical connector disclosed in JP-A H05-101853, a first and a second fix/hold member clamp a coated wire with its core wire exposed. In this state, the first and the second fix/hold members are engaged with a fix/hold member attaching portion on a support plate while a center portion of the exposed core wire is placed on a core wire support portion. Furthermore, an end portion of the exposed core wire is placed on an end holding portion of the supporting plate. Thus, a male connector is formed. Thereafter, the male connector is inserted into a cylindrical female connector in a longitudinal direction of the coated wire to bring the exposed core wire into press-contact with the contact. In the above-mentioned manner, the exposed core wire is connected to the contact. Thus, in the above-mentioned electrical connector, clamping of the coated wire and wire connection can not simultaneously be carried out and therefore required troublesome operations.

Moreover, in the above-described electrical connector, the male connector is inserted into the female connector in the longitudinal direction of the coated wire and, within the female connector, the core wire of the coated wire is pressed against the contact in the thickness direction of the male connector. Therefore, it is required to provide a pressing slider for pressing the core wire against the contact and a pressing protrusion for driving the pressing slider in the thickness direction of the male connector. This results in a complicated structure and a disadvantage in production cost.

On the other hand, the connector disclosed in JP-A H10-255921 uses a cable conductor as a plug of the connector. In this structure, a plurality of cables are arrayed on a cable holder by a cable array arranging portion (this corresponds to the clamping operation). Then, each cable conductor is placed in a cable guide groove of the cable holder. The cable conductor is bent into a U-shape to be wound around an end portion of the cable holder. An end of the cable conductor is adhered to the cable holder by lamination (this corresponds to the wire-connecting operation). Thus, the above-described connector also requires troublesome operations because the clamping of the cable and the wire connection can not simultaneously be performed. In addition, the cable array arranging portion and the lamination are required. This results in a disadvantage in production cost.

SUMMARY OF THE INVENTION

It is therefore an object of the present invention to provide a cable connector which is adaptable to a cable reduced in pitch, which low in cost, and which allows wire connection and clamping of the cable to be simultaneously carried out.

Other objects of the present invention will become clear as the description proceeds.

According to the present invention, there is provided a cable connector for use in connecting a cable having a core wire, the cable connector comprising a base insulator, a base contact coupled to the base insulator, and a pressing device for pressing the core wire against the base contact in a predetermined direction intersecting the core wire, the pressing device comprising a cover insulator coupled to the base insulator and movable in the predetermined direction, a partition wall formed integral with the cover insulator for positioning the core wire to make the core wire face the base contact in the predetermined direction, and a support contact coupled to the cover insulator and cooperated with the base contact for clamping the core wire therebetween with movement of the cover insulator towards the base insulator.

DESCRIPTION OF THE PREFERRED EMBODIMENTS

Figure 1:
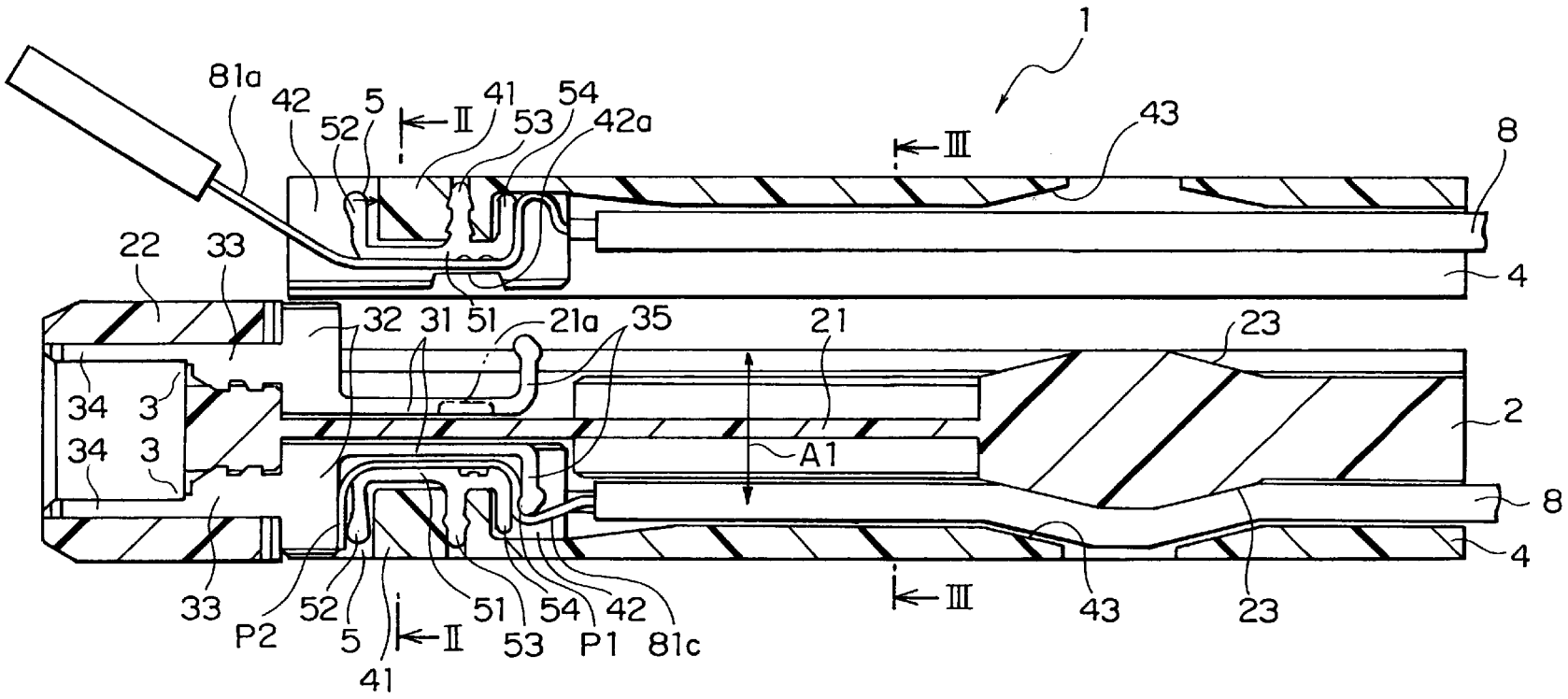
FIG. 1 is a vertical sectional view of a cable connector according to a first embodiment of the present invention.

With reference to FIGS. 1, 2, 3, 4A, 4B, and 4C, description will be made as regards a cable connector according to a first embodiment of the present invention.

The cable connector is designated by a reference numeral 1 and comprises a base insulator 2, a plurality of base contacts 3, two cover insulators 4, and a plurality of support contacts 5. The cable connector 1 is for connecting a flattened coaxial cable 8 with a drain wire to a mating connector (not shown) as an object of connection.

Figure 5A:
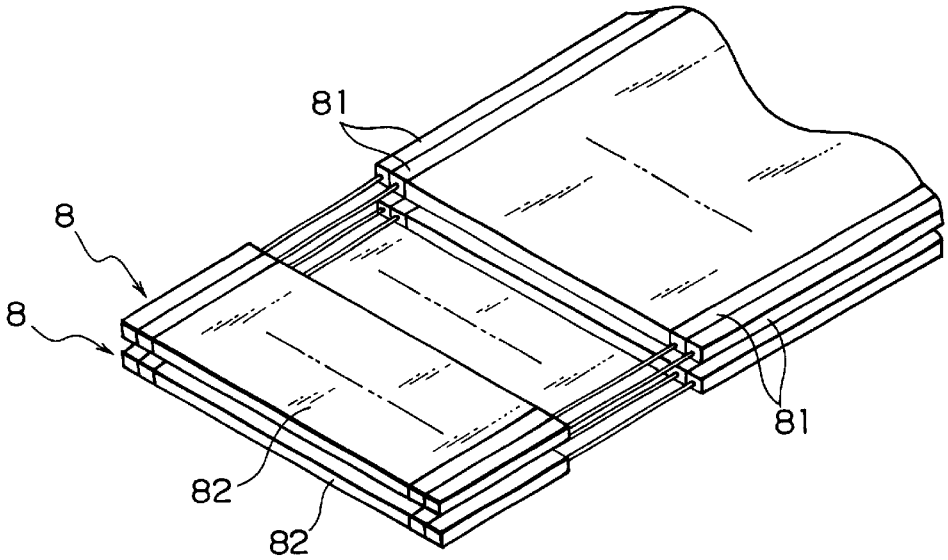
FIG. 5A is a perspective view of a flattened coaxial cable with a drain wire, which is capable of being connected to the cable connector of FIG. 1.
Figure 5B:
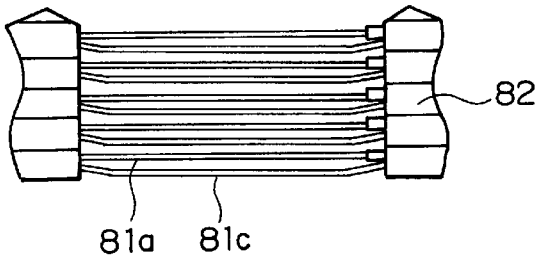
FIG. 5B is a plan view of the flattened coaxial cable of FIG. 5A.
Figure 5C:
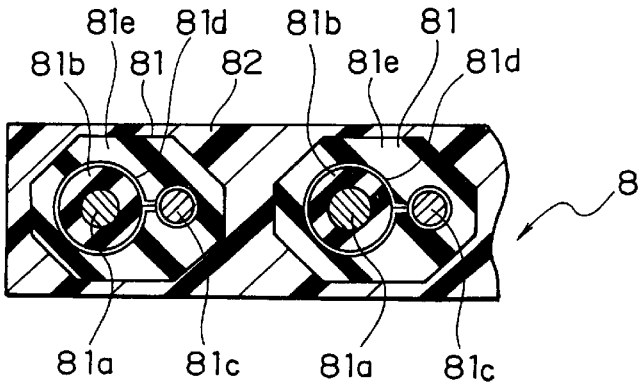
FIG. 5C is a horizontal sectional view of the flattened coaxial cable of FIG. 5A.

Referring to FIG. 5 shortly, the flattened coaxial cable 8 comprises a plurality of coaxial cables 81 with the drain wire and an UV-setting resin or film 82 coupling the coaxial cables 81. Moreover, each of the coaxial cables 81 comprises a signal wire 81*a*, a dielectric member 81*b* surrounding the signal wire 81*a*, a drain wire 81*c* extending in parallel to the signal wire 81*a*, a shield 81*d*, and a sheath 81*e*. The shield 81*d* covers the signal wire 81*a*, the dielectric member 81*b*, and the drain wire 81*c*. The sheath 81*e* accommodates the signal wire 81*a*, the dielectric member 81*b*, the drain wire 81*c*, and the shield 81*d*. In case of the flattened coaxial cable 8, the signal wire 81*a* and the drain wire 81*c* will collectively be called as a core wire.

Returning to FIGS. 1–4C, the base insulator 2 has a flat-plate portion 21, a fitting portion 22, and protrusions 23 as a first clamp portion. The flat-plate portion 21 has a plate-like shape and adapted to receive and support the coaxial cable 8 in its thickness direction. The flat-plate portion 21 is provided with a stopper 21*a* for preventing the displacement of the base contact 3 in the direction perpendicular to the drawing sheet of FIG. 1. The fitting portion 22 is a portion to be engaged with the mating connector and is formed integral with one end of the flat-plate portion 21. The protrusions 23 are formed at the other end of the flat-plate portion 21 to integrally protrude from the upper and the lower surfaces thereof, respectively. The protrusions 23 serve to clamp the coaxial cable 8 in a predetermined direction A1.

Each of the base contacts 3 has a clamping portion 31 for clamping the core wire of the coaxial cable 8, a core wire contacting portion 32 formed at one end of the clamping portion 31 to be contacted with the core wire, a press-fitted portion 33 formed at one end of the core wire contacting portion 32 to be press-fitted into the fitting portion 22, a mating connector contacting portion 34 formed at one end of the press-fit portion 33 to be brought into contact with the mating connector and a base-side elastic contacting spring 35 formed at the other end of the clamping portion 31 to press the core wire against the support contact 5. The base contacts 3 are press-fitted into the fitting portion 22 at a predetermined pitch on the upper and the lower surfaces of the flat-plate portion 21.

Figure 4B:
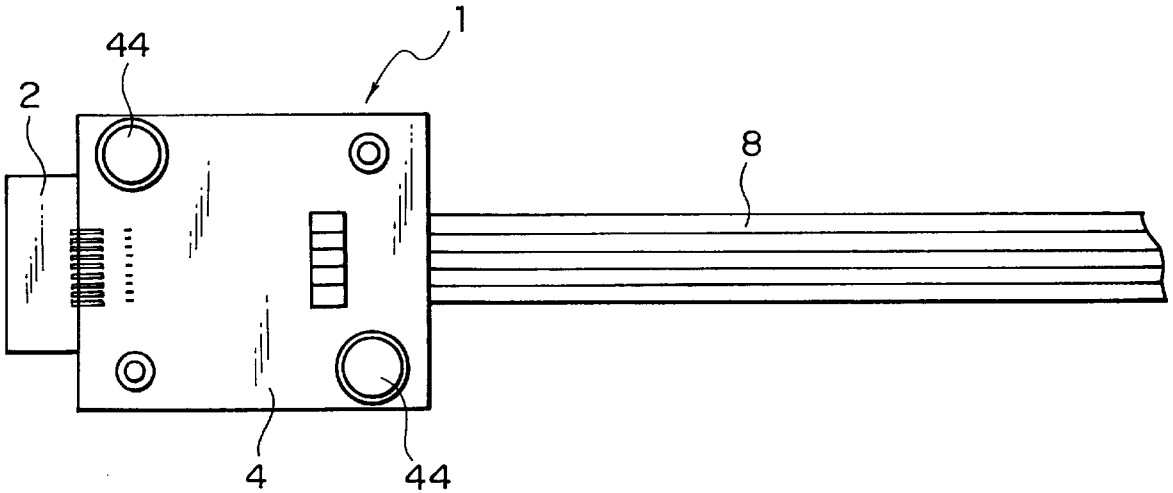
FIG. 4B is a plan view of the cable connector of FIG. 1.

Each of the cover insulators 4 has a generally flat plate-shape and comprises a plurality of contact holding portions 41 formed at its one end to be faced to the base contacts 3 in the predetermined direction A1, partition walls 42 formed on both sides of each contact holding portions 41 to position the core wire with respect to the support contact 5 and the base contact 3, and a clamp valley 43 as a second clamping portion which is formed on the side of the base insulator 2 at the other end of the cover insulator 4 to clamp, in the predetermined direction A1, the coaxial cable 8 at its end surface in its thickness direction in cooperation with the protrusions 23. The partition wall 42 is provided with a recess 42*a* to avoid contact with the stopper 21*a* formed on the base insulator 2. The two cover insulators 4 are abutted or assembled to the base insulator 2 to sandwich the base insulator 2 therebetween in the above-mentioned predetermined direction a. In this state, the cover insulators are coupled to each other by the use of screws 44 to be fixed to the base insulator 2 as shown in FIG. 4B.

Each of the support contacts 5 is generally E-shaped and comprises a clamping portion 51 for clamping the core wire of the coaxial cable 8 in cooperation with the clamping portion 31 of the base contact 3 where the cover insulators 4 are abutted to the base insulator 2, a support-side elastic contacting spring 52 formed at one end of the clamping portion 51 to press the core wire against the core wire contacting portion 32 of the base contact 3, a press-fit portion 53 formed at the center portion of the clamping portion 51 to be pressfitted into the contact holding portion 41 of the cover insulator 4, and a receiving portion 54 formed at the other end of the clamping portion 51 to be faced to the base-side elastic contacting spring 35 of the base contact 3 and to receive the core wire pressed by the base side elastic contacting spring 35. Each of the support contacts 5 is arranged between the partition walls 42 by press-fitting the press-fit portion 53 into the contact holding portion 41 of the cover insulator 4. Next, description will be made about a wire connection method for connecting the flattened coaxial cable 8 to the cable connector 1.

At first, the UV-setting resin 82, the sheath 81*e*, the shield 81*d*, and the dielectric member 81*b* are cut off in the vicinity of a terminal end of the coaxial cable 8. A portion between the cut-off portion and the terminal end is displaced toward the terminal end of the cable as far as it is not released from the signal wire 81*a* and the drain wire 81*c*. Thus, a part of each of the signal wire 81*a* and the drain wire 81*c* is half-stripped as shown in FIGS. 5A and 5B.

In this state, the coaxial cable 8 is then placed on the cover insulator 4, as shown above the base insulator 2 illustrated in FIGS. 1 to 3. At this time, each of the signal wire 81*a* and the drain wire 81*c* of the coaxial cable 8 is arranged between the partition walls 42 to bring each of the signal wire 81*a* and the drain wire 81*c* into contact with the support contact 5.

Figure 2:
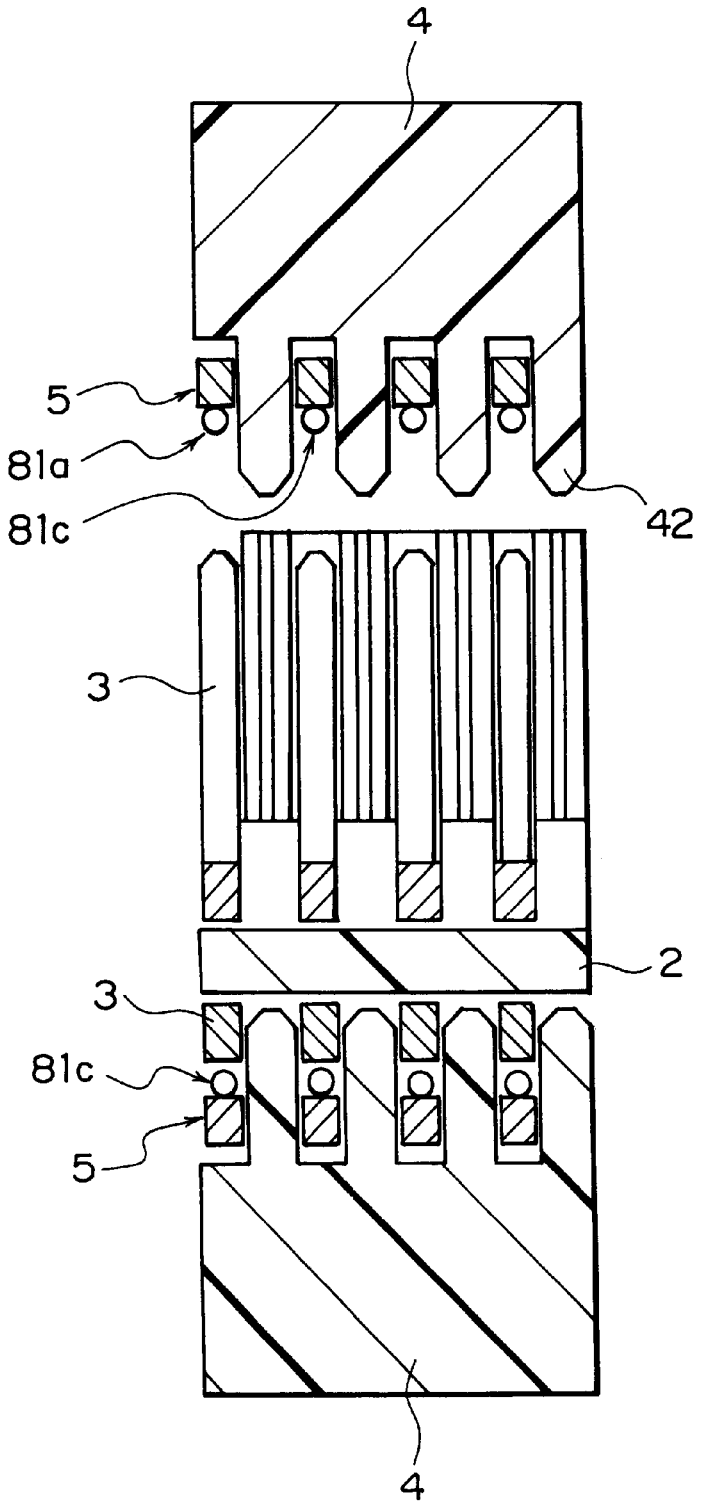
FIG. 2 is a sectional view taken along a line II—II in FIG. 1.
Figure 3:
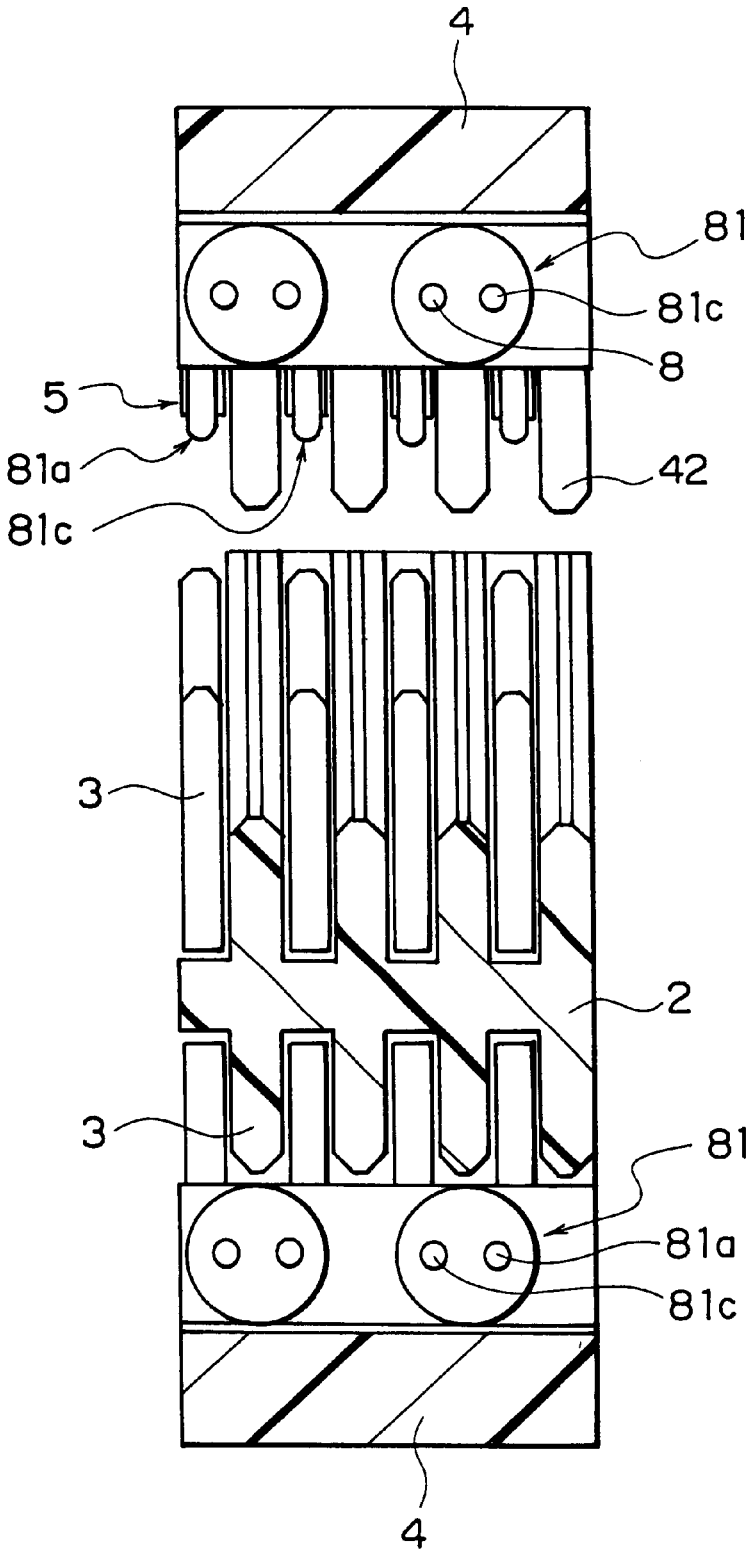
FIG. 3 is a sectional view taken along a line III—III in FIG. 1.
Figure 4C:
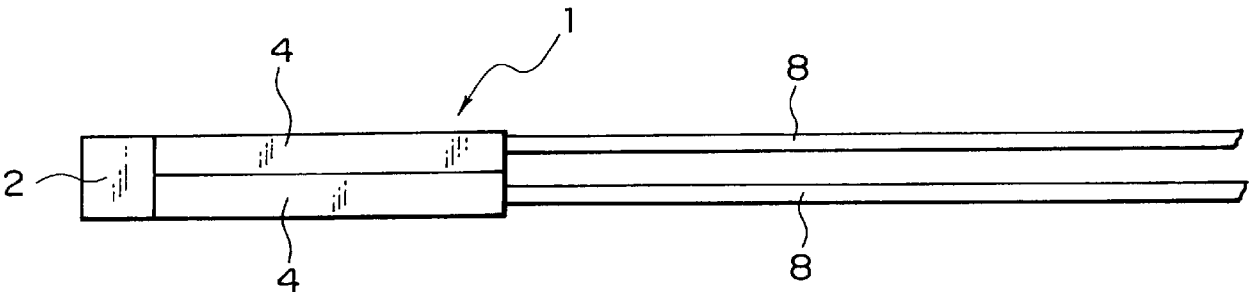
FIG. 4C is a side view of the cable connector of FIG. 1.
Figure 4A:
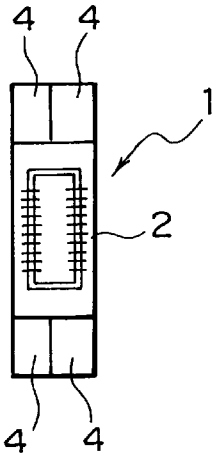
FIG. 4A is a front view of the cable connector of FIG. 1.

Next, the cover insulator 4 with the coaxial cable 8 arranged thereon is abutted to the base insulator 2 together with the coaxial cable 8 in the predetermined direction A1, as shown below the base insulator 2 illustrated in FIGS. 1 to 3. As a result, each of the signal wire 81*a* and the drain wire 81 of the coaxial cable 8 is clamped by the base contact 3 and the support contact 5 so that each of the signal wire 81*a* and the drain wire 81*c* is connected to the base contact 3. Simultaneously, the coaxial cable 8 is clamped by the protrusions 23 and the clamp valley 43 in the predetermined direction A1 at an unexposed portion where the signal wire 81*a* and the drain wire 81*c* are not exposed. In this state, each of the signal wire 81*a* and the drain wire 81*c* is electrically connected to the base contact 3 at least at two points, namely points P1 and P2, by the base side elastic contacting spring 35 and the support side elastic contacting spring 52. Then, as shown in FIGS. 4A–4C, the cover insulators 4 abutted to the base insulator 2 from the upper and the lower sides are coupled to each other by the use of the screws 44 to fix the cover insulators 4 to the base insulator 2.

Finally, excessive parts of the signal wire 81*a* and the drain wire 81*c* are cut off and removed together with the UV-setting resin 82, the sheath 81*e*, the shield 81*d*, and the dielectric member 81*b* which have been cut off at one end of the coaxial cable 8. The cable connector 1 is completed through the above-described steps.

Figure 6:
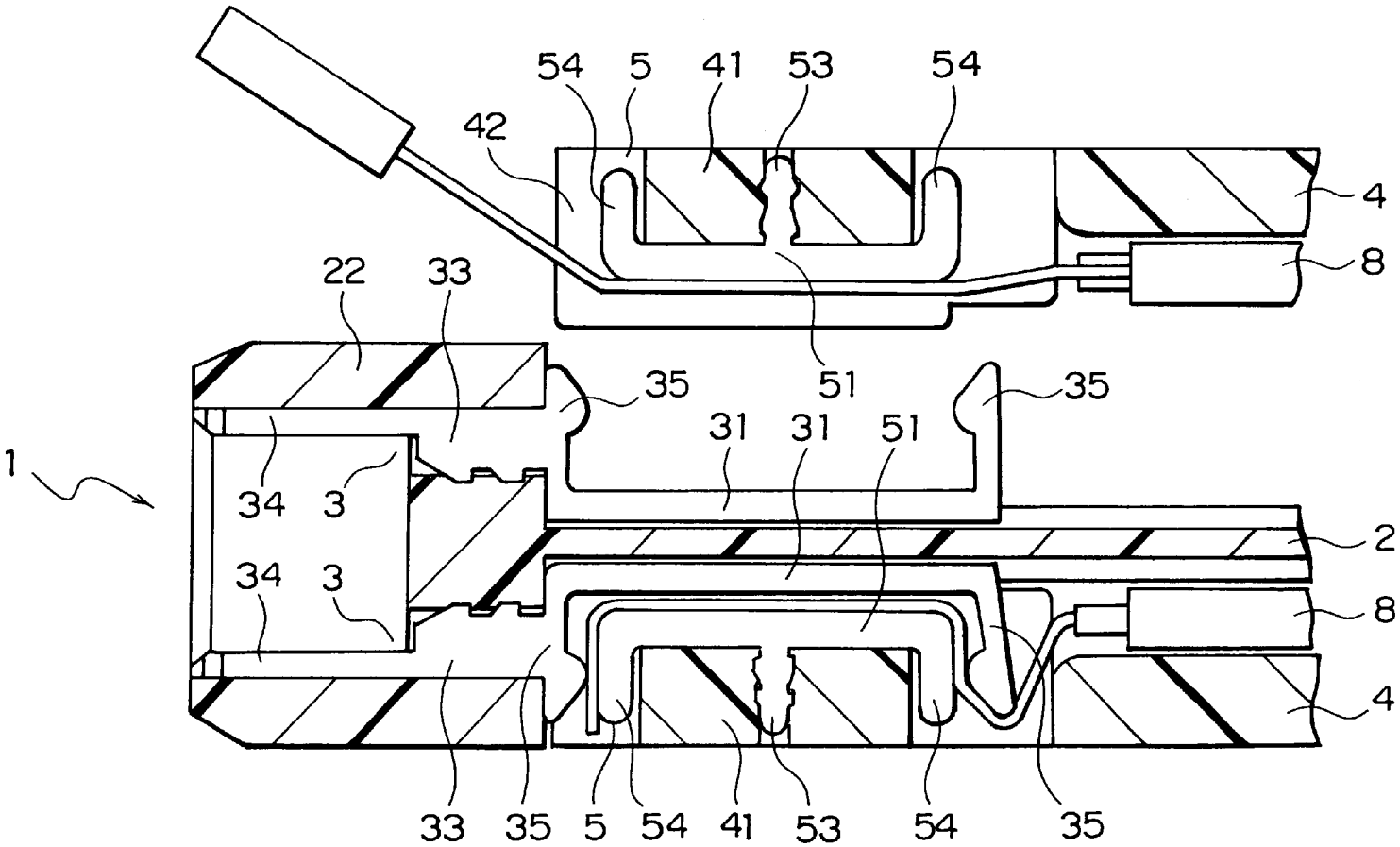
FIG. 6 is a vertical sectional view of a cable connector according to a second embodiment of the present invention.

With reference to FIG. 6, the description will be made as regards a cable connector according to a second embodiment of the present invention. Similar parts are designated by like reference numerals. In the cable connector 1 of FIG. 6, the base-side elastic contacting springs 35 are formed integral with both ends of the clamping portion 31 of the base contact 3. The receiving portions 54 are formed integral with both ends of the support contact 5. The base-side elastic contacting springs 35 of the base contact 3 clamp the core wire of the coaxial cable 8 in cooperation with the receiving portions 54 of the support contact 5.

Figure 7:
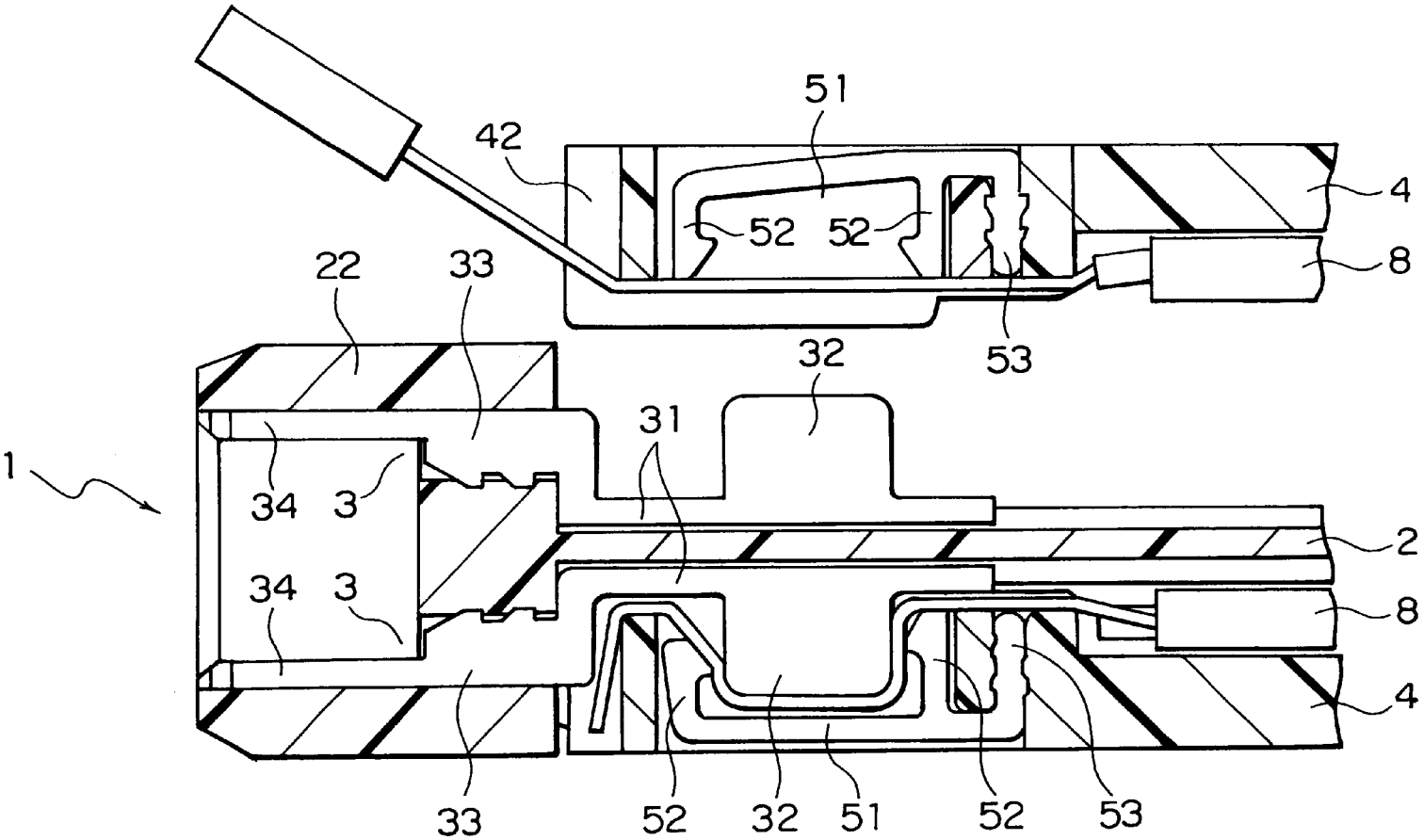
FIG. 7 is a vertical sectional view of a cable connector according to a third embodiment of a present invention.

With reference to FIG. 7, the description will be made as regards a cable connector according to a third embodiment of the present invention. Similar parts are designated by like reference numerals. In the cable connector 1 of FIG. 7, the core wire contacting portion 32 is formed integral with the center of the clamping portion 31 of the base contact 3. A pair of the support-side elastic contacting springs 52 are formed integral with the clamping portion 51 of the support contact 5. The press-fit portion 53 is formed integral with one end of the clamping portion 51. The above-mentioned pair of support-side elastic contacting springs 52 clamp the core wire of the coaxial cable 8 and press the core wire against the core wire contacting portion 32.

Figure 8:
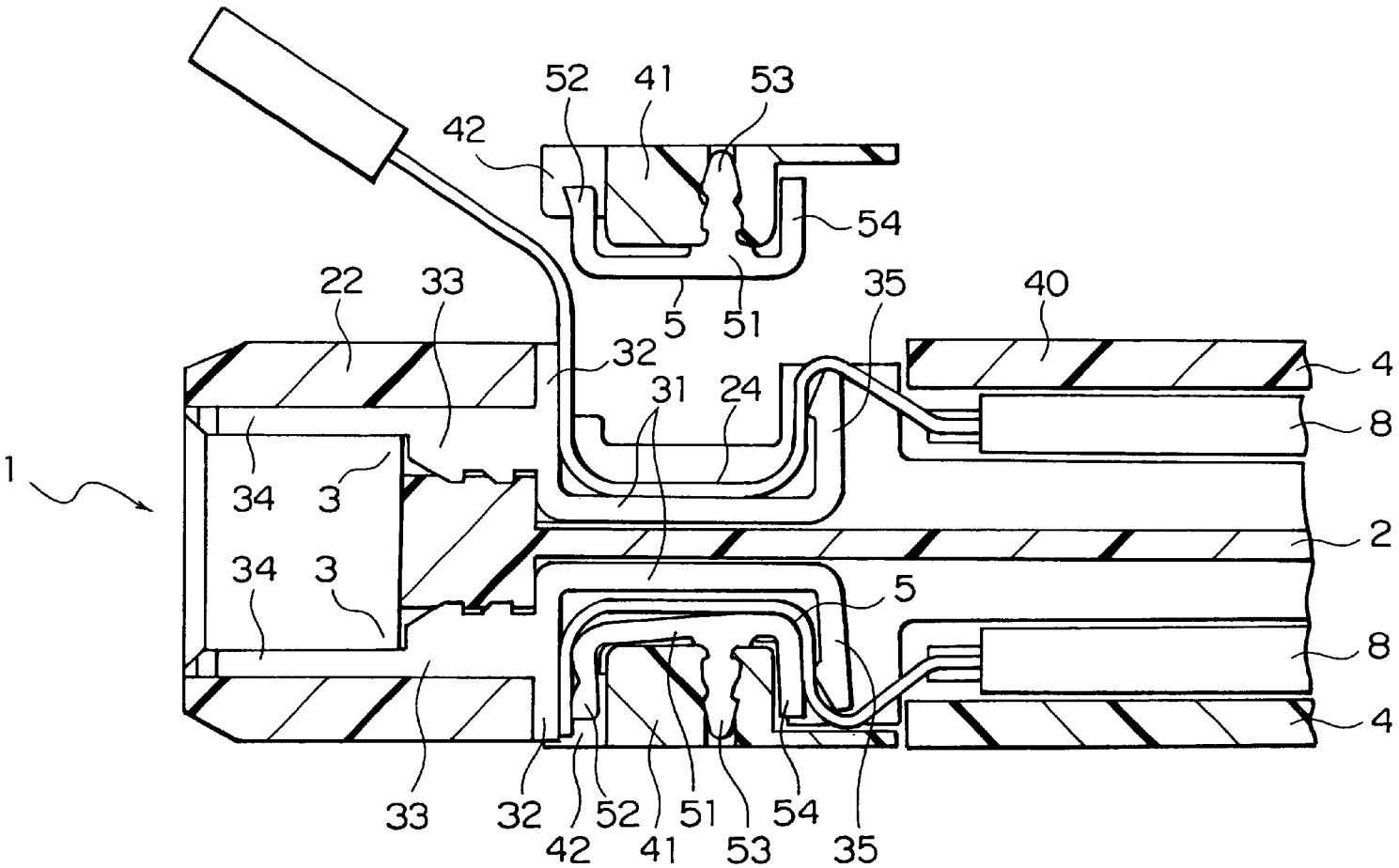
FIG. 8 is a vertical sectional view of a cable connector according to a fourth embodiment of the present invention.

With reference to FIG. 8, the description will be made as regards a cable connector according to a fourth embodiment of the present invention. Similar parts are designated by like reference numerals. In the cable connector 1 of FIG. 8, the cover insulator 4 comprises a cover insulator body 40 having the clamp valley (not shown) and the contact holding portion 41 which is a component separate from the cover insulator body 40, which has the partition wall 42, and which is removable from the cover insulator main body 40. In the cable connector 1, the base insulator 2 is also provided with a partition wall 24. The fourth embodiment has a structure substantially same to that of the first embodiment if the contact holding portion 41 is attached to the cover insulator body 40. However, in the fourth embodiment, it is possible to perform connection of the core wire as a last step by attaching the contact holding portion 41 to the cover insulator body 40 after the cover insulator body 40 is fixed to the base insulator 2.

Figure 9:
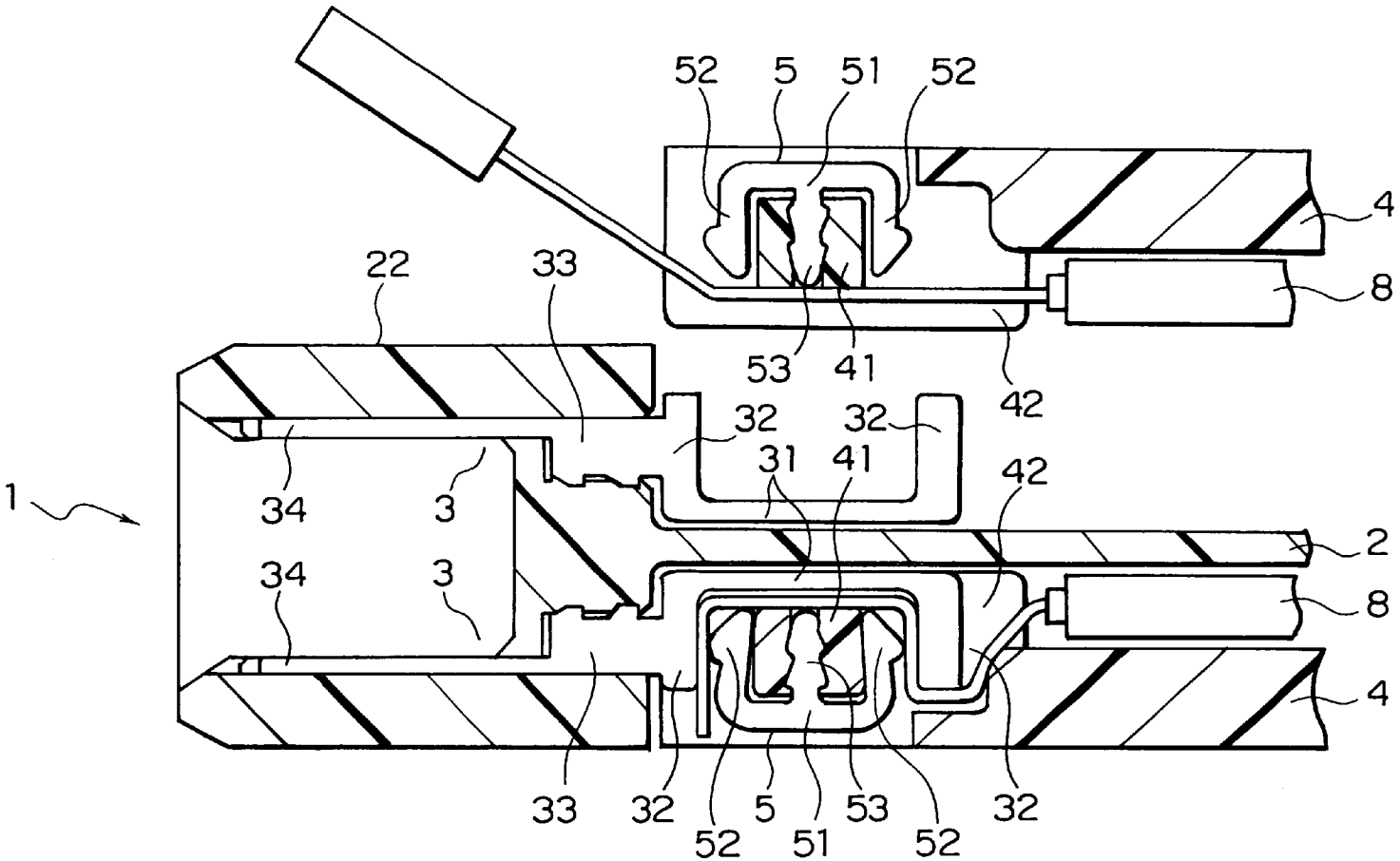
FIG. 9 is a vertical sectional view of a cable connector according to a fifth embodiment of the present invention.

With reference to FIG. 9, the description will be made as regards a cable connector according to a fifth embodiment of the present invention. Similar parts are designated by like reference numerals. In the cable connector 1 of FIG. 9, the core wire contacting portions 32 are formed integral with both ends of the clamping portion 31 of the base contact 3. The support-side elastic contacting springs 52 are formed integral with both ends of the clamping portion 51 of the support contact 5. The most characteristic part of this embodiment is the contact holding portion 41 of the cover insulator 4. The contact holding portion 41 is adapted to press the core wire of the coaxial cable 8 against the base contact 3 in cooperation with the support contact 5.

Figure 10:
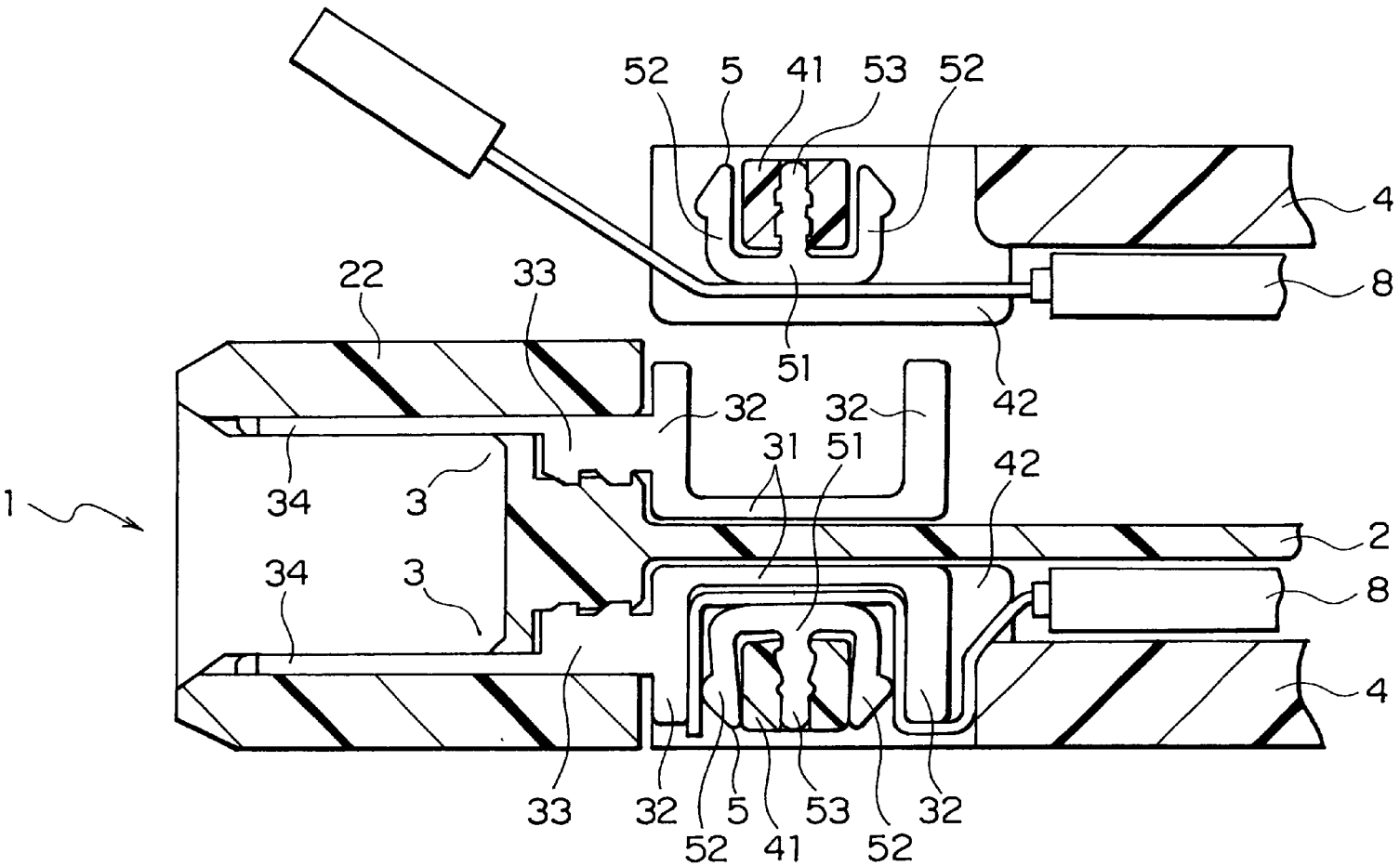
FIG. 10 is a vertical sectional view of a cable connector according to a sixth embodiment of the present invention.

With reference to FIG. 10, the description will be made as regards a cable connector according to a sixth embodiment of the present invention. Similar parts are designated by like reference numerals. The cable connector 1 of FIG. 10 is generally similar in structure to the cable connector of FIG. 9. However, the contact holding portion 41 of the cover insulator 4 is not adapted to press the core wire of the coaxial cable 8 against the base contact 3. The support contact 5 is press-fitted into the contact holding portion 41 so that the clamping portion 51 is located at one side of the contact holding portion 41 faced to base insulator 2.

Figure 11:
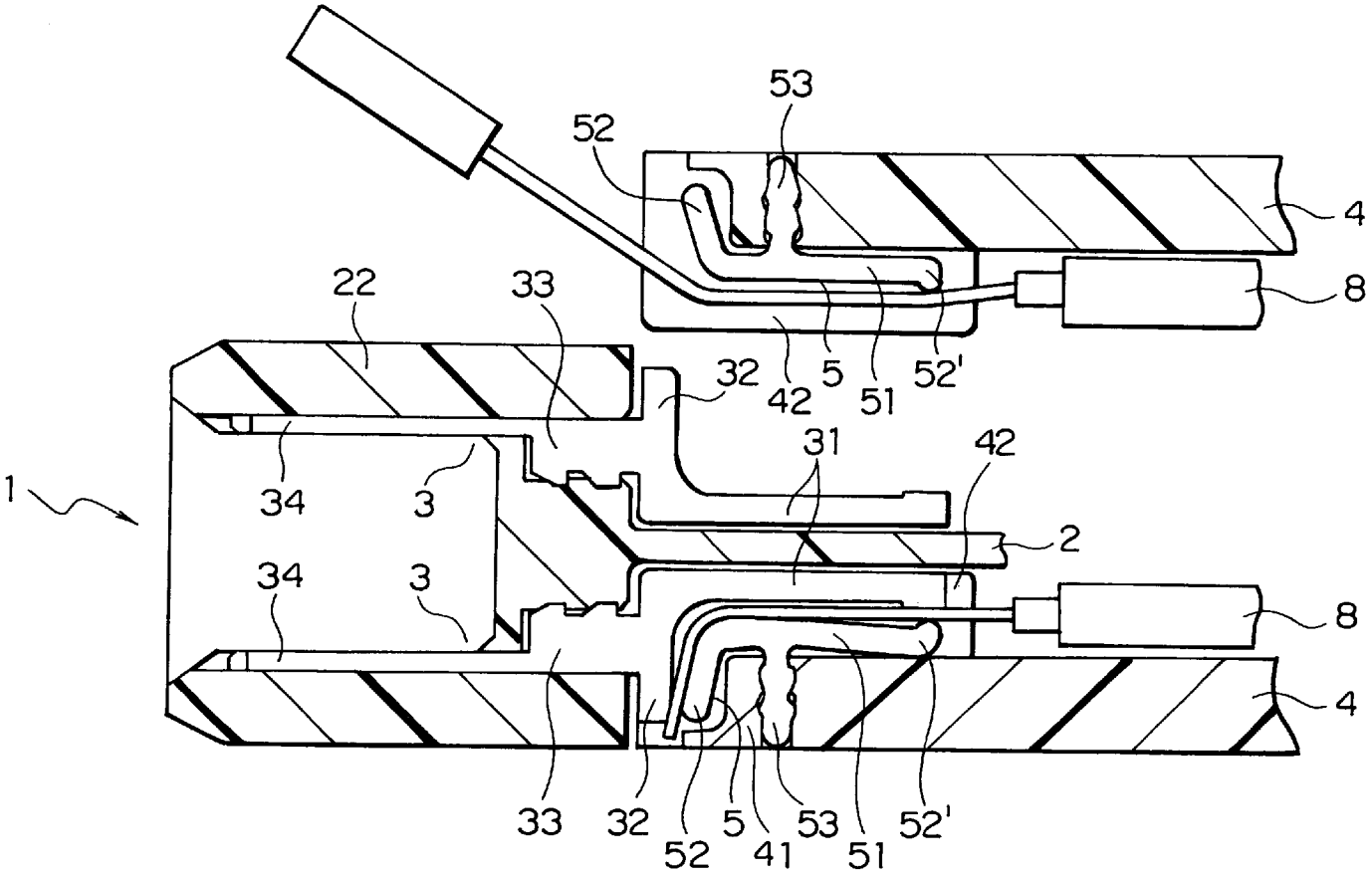
FIG. 11 is a vertical sectional view of a cable connector according to a seventh embodiment of the present invention.

With reference to FIG. 11, the description will be made as regards a cable connector according to a seventh embodiment of the present invention. Similar parts are designated by like reference numerals. In the cable connector 1 of FIG. 11, the core wire contacting portion 32 is formed integral with one end of the clamping portion 31 of the base contact 3 while nothing is provided at the other end of the clamping portion 31. The first support-side elastic contacting spring 52 is formed at one end of the clamping portion 51 of the support contact 5 while the second support-side elastic contacting spring 52' is formed at the other end of the clamping portion 51 to be aligned therewith.

Figure 12:
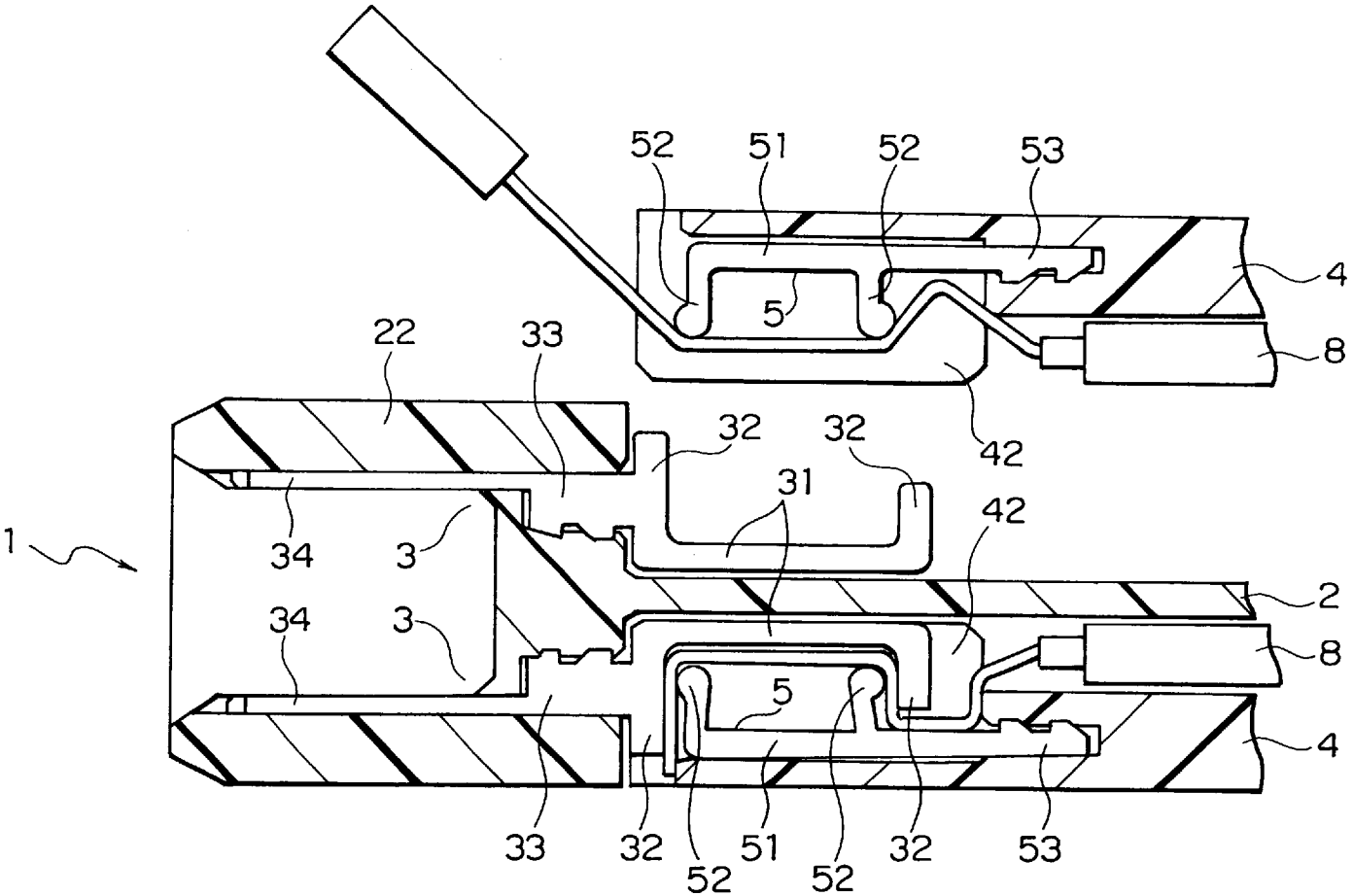
FIG. 12 is a vertical sectional view of a cable connector according to an eighth embodiment of the present invention.

With reference to FIG. 12, the description will be made as regards a cable connector according to an eighth embodiment of the present invention. Similar parts are designated by like reference numerals. In the cable connector 1 of FIG. 12, the core wire contacting portions 32 are formed integral with both ends of the clamping portion 31 of the base contact 3. The support-side elastic contacting springs 52 are formed integral with one end and at the center of the clamping portion 51 of the support contact 5. The press-fit portion 53 is formed integral with the other end of the clamping portion 51 to be aligned with the clamping portion 51.

Figure 13:
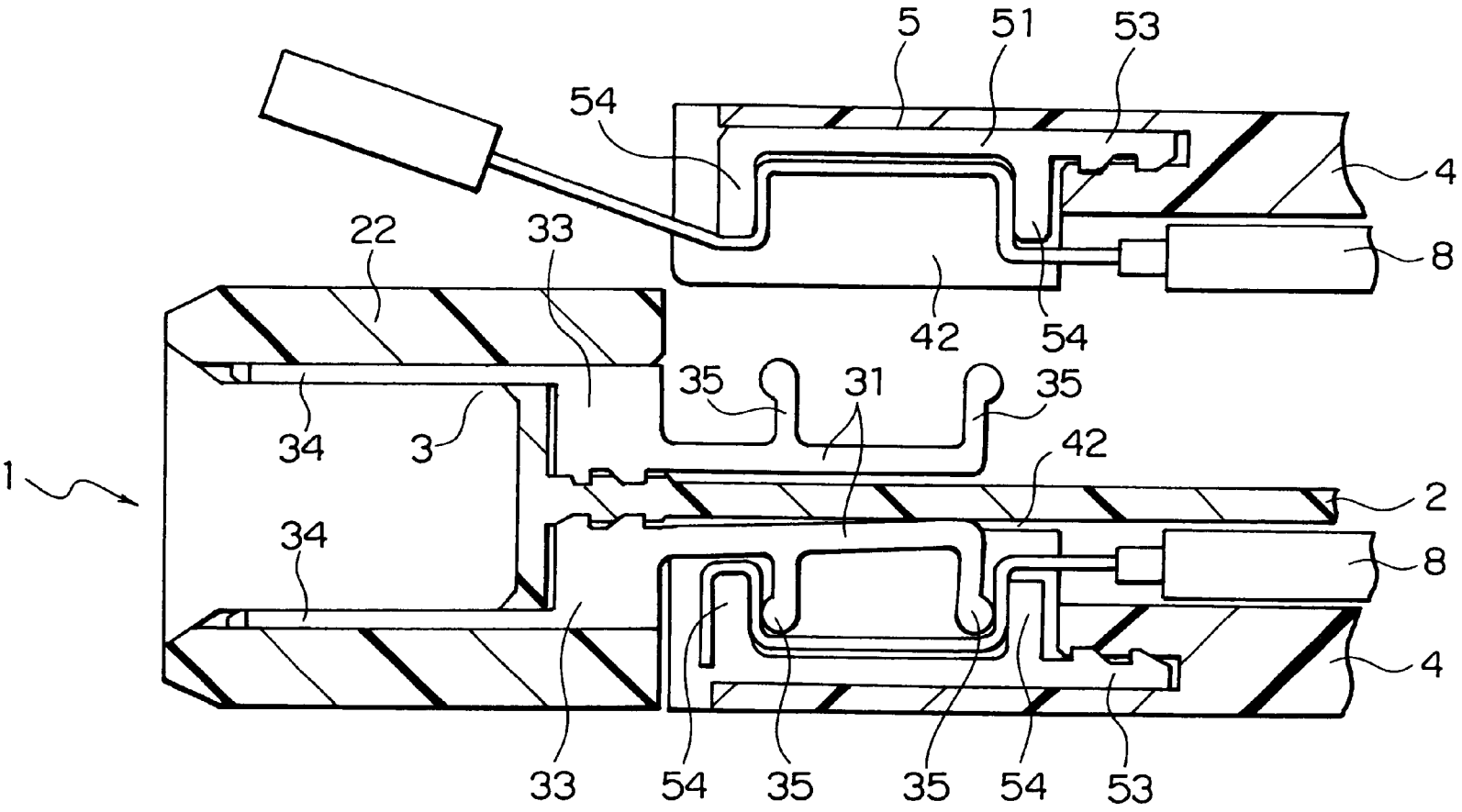
FIG. 13 is a vertical sectional view of a cable connector according to a ninth embodiment of the present invention.

With reference to FIG. 13, the description will be made as regards a cable connector according to a ninth embodiment of the present invention. Similar parts are designated by like reference numerals. The cable connector 1 of FIG. 13 has a structure such that the relationship between the core wire contacting portion 32 and the support-side elastic contacting spring 52 is reverse to that of the cable connector of FIG. 12. Specifically, the base-side elastic contacting springs 35 are formed integral with one end and with the center of the clamping portion 31 of the base contact 3, the receiving portions 54 being formed at both ends of the clamping portion 51 of the support contact 5.

Figure 14:
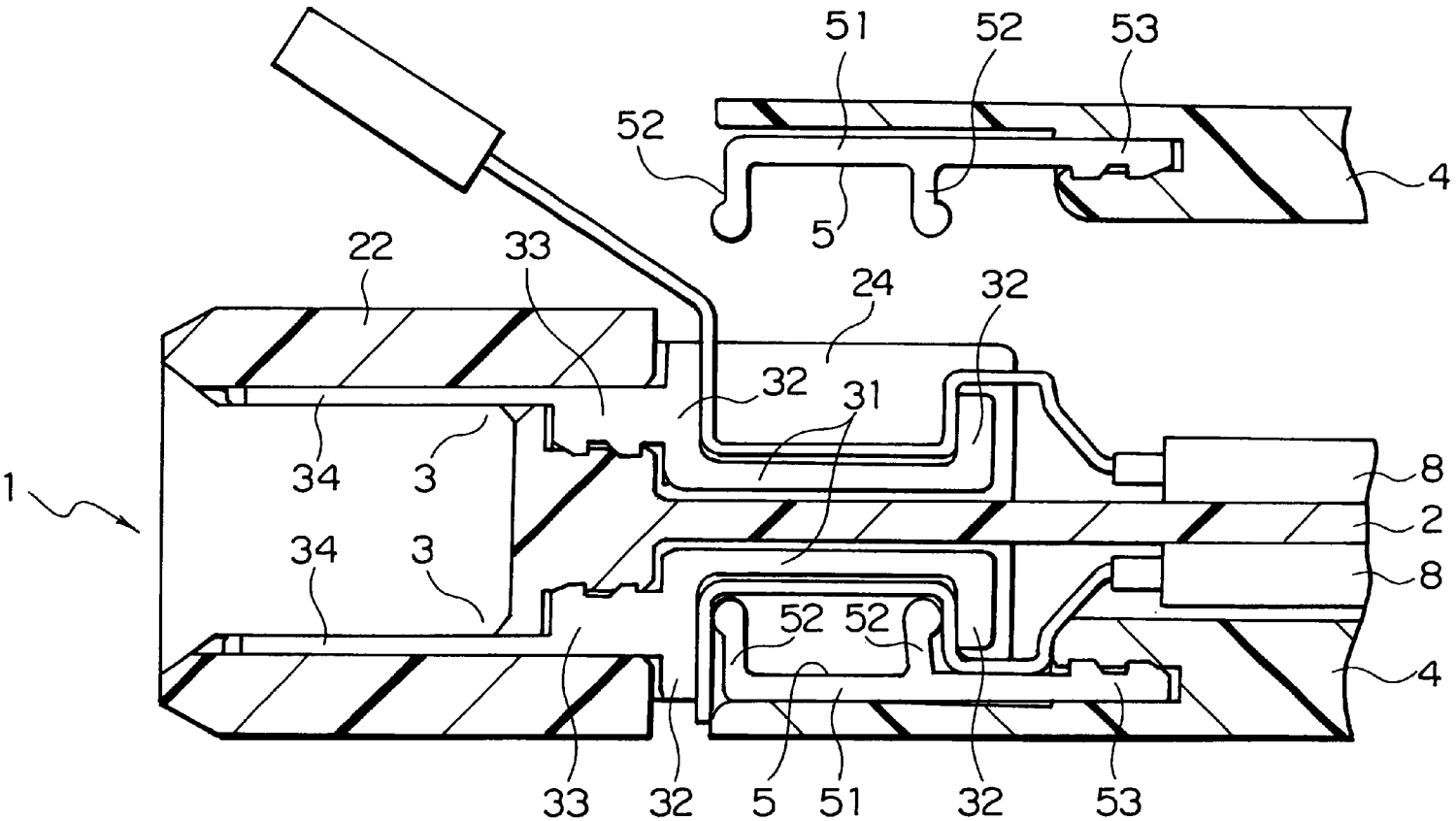
FIG. 14 is a vertical sectional view of a cable connector according to a tenth embodiment of the present invention.

With reference to FIG. 14, the description will be made as regards a cable connector according to a tenth embodiment of the present invention. Similar parts are designated by like reference numerals. The cable connector 1 of FIG. 14 is substantially similar in structure to the cable connector of FIG. 12 except that the cover insulator 4 is not provided with the partition wall. Instead, the base insulator 2 is provided with the partition wall 24. In the cable connector of FIG. 14, the coaxial cable 82 is at first placed on the base insulator 2. Then, the cover insulator 4 is abutted and fixed to the base insulator 2.

While the present invention has thus far been described in connection with a few embodiments thereof, it will readily be possible for those skilled in the art to put this invention into practice in various other manners. For example, the cover insulator may be fixed to only one surface of the base insulator. The partition wall may be formed in each of the cover insulator and the base insulator. Alternatively, the partition wall may be formed only on the base insulator. The support contact may be connected to the connection object. Further alternatively, both of the base contact and the support contact may be connected to the connection object. The cover insulator may be fixed to the base insulator, for example, by the use of an engaging mechanism such as engaging claws. Moreover, the cable connector can be applied not only to the flattened coaxial cable with a drain wire but also to various common cables.

What is claimed is:

1. A cable connector for use in connecting a cable having a core wire, said cable connector comprising a base insulator, a base contact coupled to said base insulator, and a pressing device for pressing said core wire against said base contact in a predetermined direction intersecting said core wire, said pressing device comprising:

a cover insulator coupled to said base insulator and movable in said predetermined direction;

a partition wall formed integral with said cover insulator for positioning said core wire to make said core wire face said base contact in said predetermined direction; and a support contact coupled to said cover insulator and cooperated with said base contact for clamping said core wire therebetween with movement of said cover insulator towards said base insulator.

2. A cable connector as claimed in claim 1, wherein at least one of said base contact and said support contact has an elastic contacting spring portion for electrically connecting said core wire to said at least one of these base contacts and these support contacts.

3. A cable connector as claimed in claim 1, wherein said base insulator has a stopper for preventing said base contact from being displaced in a direction which is perpendicular to said predetermined direction and said core wire.

4. A cable connector as claimed in claim 1, further comprising at least one screw for fixing said cover insulator to said base insulator.

5. A cable connector as claimed in claim 1, further comprising an engaging mechanism for fixing said cover insulator to said base insulator.

6. A cable connector as claimed in claim 1, wherein said base insulator has a first clamping portion, said cover insulator having a second clamping portion cooperated with said first clamping portion for clamping said cable in said predetermined direction.

* * * * *